United States Patent [19]

Branovich et al.

[11] Patent Number: 4,863,410

[45] Date of Patent: Sep. 5, 1989

[54] METHOD OF MAKING A LONG LIFE HIGH CURRENT DENSITY CATHODE FROM TUNGSTEN AND IRIDIUM POWDERS USING A LOW MELTING POINT IMPREGNANT

[75] Inventors: Louis E. Branovich, Howell Township, Monmouth County; Bernard Smith, Ocean; Gerard L. Freeman, Freehold Township, Manmouth County; Donald W. Eckart, Wall Township, Belmar County, all of N.J.

[73] Assignee: The United States of America as represented by the Secretary of the Army, Washington, D.C.

[21] Appl. No.: 224,980

[22] Filed: Jul. 21, 1988

[51] Int. Cl.[4] ..... H01J 9/04

[52] U.S. Cl. ..... 445/50; 313/346 DC

[58] Field of Search ..... 445/50, 51; 313/346 DC, 313/346 R

[56] References Cited

U.S. PATENT DOCUMENTS

| | | | |
|---|---|---|---|
| 4,671,777 | 6/1987 | Van Esdonk et al. | 445/51 |
| 4,708,681 | 11/1987 | Branovich et al. | 445/50 |
| 4,735,591 | 4/1988 | Branovich et al. | 445/50 |

FOREIGN PATENT DOCUMENTS

| | | | |
|---|---|---|---|
| 2153912 | 5/1973 | Fed. Rep. of Germany | 313/346 DC |

*Primary Examiner*—Kenneth J. Ramsey

*Attorney, Agent, or Firm*—Sheldon Kanars; Roy E. Gordon

[57] ABSTRACT

A long life high current density cathode is made from a mixture of tungsten and iridium powders by processing the mixture of powders with an activator into a porous billet, and then impregnating the billet with a low melting point impregnant by firing the billet in a dry hydrogen furnace at a temperature at which the impregnant melts.

2 Claims, No Drawings

METHOD OF MAKING A LONG LIFE HIGH CURRENT DENSITY CATHODE FROM TUNGSTEN AND IRIDIUM POWDERS USING A LOW MELTING POINT IMPREGNANT

The invention described herein may be manufactured, used, and licensed by the Government for governmental purposes without the payment to us of any royalty thereon.

This invention relates in general, to a method of making a long life high current density cathode and in particular, to a method of making such a cathode from a mixture of tungsten and iridium powders using a low melting point impregnant.

BACKGROUND OF THE INVENTION

In U.S. Pat. No. 4,708,681, issued Nov. 24, 1987, for "Method of Making a Long Lived High Current Density Cathode From Tungsten and Iridium Powders", to L. E. Branovich, G. L. Freeman, and B. Smith, and assigned to a common assignee, there is disclosed and claimed a method of making a long life high current density cathode suitable for operation in millimeter wave and microwave devices in which a mixture of tungsten and iridium powders is processed with an activator into a porous billet, and the porous billet then impregnated with a chemical mixture of barium oxide, strontium oxide and aluminum oxide by firing the billet in a dry hydrogen furnace at a temperature at which the impregnant melts.

In U.S. Pat. No. 4,735,591, issued Apr. 5, 1988 for "Method of Making a Long Life High Current Density Cathode From Tungsten and Iridium Powders Using a Barium Iridiate as the Impregnant", to L. E. Branovich, G. L. Freeman and B. Smith, and assigned to a common assignee, there is disclosed and claimed a method of making a long life high current density cathode suitable for operation in millimeter and microwave devices in which a mixture of tungsten and iridium powders is processed with an activator into a porous billet, and the porous billet then impregnated with barium iridiate by firing the billet in a dry hydrogen furnace at a temperature at which the impregnant melts.

This application is also copending with U.S. patent application Ser. No. 213,035, filed June 27, 1988, for "Method of Making a Long Life High Current Density Cathode From Tungsten and Osmium Powders Using a Barium Osmiate as the Impregnant", by L. E. Branovich, G. L. Freeman and B. Smith, and assigned to a common assignee. In that application, there is disclosed and claimed a method of making a long life high current density cathode suitable for operation in millimeter wave and microwave devices in which a mixture of tungsten and osmium powders is processed with an activator into a porous billet, and the porous billet then impregnated with a barium osmiate by firing the billet in a dry hydrogen furnace at a temperature at which the impregnant melts.

Though the cathodes prepared by the methods of U.S. Pat. Nos. 4,708,681 and 4,735,591 and Ser. No. 213,035, have desirable emission characteristics, it would be even more desirable to provide a method of making a cathode having an even longer life and a higher current density.

SUMMARY OF THE INVENTION

The general object of this invention is to provide a method of making a cathode having a long life and a high current density. A further object of the invention is to provide such a method of making a cathode suitable for use in microwave and millimeter wave tubes.

It has now been found that the aforementioned objectives can be achieved by preparing a tungsten-iridium billet and impregnating the billet with a low melting temperature impregnant.

By a low melting temperature impregnant is meant an impregnant whose melting temperature is about 1385° C. to about 1450° C. Such an impregnant is exemplified by barium gallate $Ba_3Ga_2O_6$ whose melting temperature is about 1385° C. and by barium indate $Ba_3In_2O_6$ or $Ba_4In_2O_7$ whose melting temperature is about 1450° C.

The use of the low melting temperature impregnant leaves more barium available for thermionic emission thus resulting in a cathode of longer life and higher emission. This is because the use of the lower melting point material prevents Ba, BaO from escaping during impregnation. In other words, the impregnant is caused to be more barium rich because of the low melting point thus giving the cathode longer life and a greater current density.

DESCRIPTION OF THE PREFERRED EMBODIMENT

The tungsten-iridium billet is first prepared by the method as disclosed and claimed in U.S. Pat. No. 4,708,681. More particularly, tungsten and iridium powders are mixed in the weight ratio of about 60 weight percent tungsten to about 39 weight percent iridium. About 1 weight percent of an activator such as zirconium hydride is added to the mixture. The mixture is ball milled for about 8 hours and the ball milled mixture then pressed into a billet at about 48,000 p.s.i. in a die. The billet is sintered at about 1800° C. for about thirty minutes in dry hydrogen of less than −100 dewpoint and the billet then backfilled with copper in dry hydrogen at about 1150° C. The billet is machined to the desired geometry and the copper then removed by etching in nitric acid. The billet is then thoroughly rinsed in deionized water, methanol and then dried. The tungsten-iridium billet is fired in dry hydrogen to about 1400° C. for about 15 minutes and then impregnated with barium gallate by firing the billet in a dry hydrogen furnace at about 1385° C. for about 2 minutes. The billet is removed from the furnace after the furnace is cooled, and any loose pieces of impregnant are removed from the billet.

In lieu of barium gallate as the impregnant one might use barium indate in which case, the billet would be fired at about 1450° C.

The cathode operation is similar to other cathode operations. That is, it is heated in vacuum, and a chemical reaction takes place and barium atoms are released which coat the cathode surface.

The rate of barium atom formation is much faster at the same operating temperature in the case of the tungsten-iridium billet than the normal tungsten billet.

In the method of the invention, a small amount of an activator as for example, zirconium hydride is included in the billet. The activator enhances the generation of barium atoms at the cathode operating temperature.

We with it to be understood that we do not desire to be limited to the exact details of construction as described for obvious modifications will occur to a person skilled in the art.

What is claimed is:

1. Method of making a long life high current density cathode suitable for operation in microwave devices from tungsten and iridium powders using barium gallate as a low melting point impregnant, said method including the steps of:

(A) mixing the tungsten and iridium powders in a weight ratio of about 60 weight percent tungsten to about 39 weight percent iridium, (B) adding about 1 percent by weight of zirconium hydride to the mixture, (C) ball milling the mixture for about 8 hours, (D) pressing the ball milled mixture into a billet at about 48,000 psi in a die, (E) sintering the billet at about 1800° C. for about ½ hour in dry hydrogen of less than −100 dewpoint, (F) backfilling the billet with copper in dry hydrogen at about 1150° C., (G) machining the billet to the desired geometry, (H) removing the copper by etching in nitric acid, (I) thoroughly rinsing in deionized water, methanol and then drying, (J) firing the billet in dry hydrogen to about 1400° C. for about 15 minutes, (K) impregnating the billet with barium gallate by firing the billet in a dry hydrogen furnace at about 1385° C. for about 2 minutes.

(L) removing the millet from the furnace after the furnace is cooled, and (M) removing any loose pieces of impregnant from the billet.

2. Method of making a long life high current density cathode suitable for operation in microwave devices from tungsten and iridium powders using barium indate as a low melting point impregnant, said method including the steps of:

(A) mixing the tungsten and iridiaum powders in a weight ratio of about 60 weight percent tungsten to about 39 weight percent iridium, (B) adding about 1 percent by weight of zirconium hydride to the mixture, (C) ball milling the mixture for about 8 hours, (D) pressing the ball milled mixture into a billet at about 48,000 psi in a die, (E) sintering the billet at about 1800° C. for about ½ hour in dry hydrogen of less than −100 dewpoint, (F) backfilling the billet with copper in dry hydrogen at about 1150° C., (G) machining the billet to the desired geometry, (H) removing the copper by etching in nitric acid, (I) thoroughly rinsing in deionized water, methanol and then drying, (J) firing the billet in dry hydrogen to about 1400° C. for about 15 minutes.

(K) impregnating the billet with barium indate by firing the billet in a dry hydrogen furnace at about 1450° C. for about 2 minutes, (L) removing the billet from the furnace after the furnace is cooled, and (M) removing any loose pieces of impregnant from the billet.

* * * * *